US006221241B1

(12) United States Patent
Carnell et al.

(10) Patent No.: US 6,221,241 B1
(45) Date of Patent: Apr. 24, 2001

(54) PROCESS FOR REMOVAL OF SULPHUR TOGETHER WITH OTHER CONTAMINANTS FROM FLUIDS

(75) Inventors: Peter John Herbert Carnell, Stockton on Tees; Edwin Stephen Willis, Northallerton, both of (GB)

(73) Assignee: Imperial Chemical Industries PLC (GB)

( * ) Notice: Subject to any disclaimer, the term of this patent is extended or adjusted under 35 U.S.C. 154(b) by 0 days.

(21) Appl. No.: 09/426,914

(22) Filed: Oct. 26, 1999

Related U.S. Application Data

(63) Continuation of application No. 09/145,165, filed on Sep. 2, 1998, now Pat. No. 6,007,706, and a continuation of application No. PCT/GB97/00903, filed on Apr. 1, 1997.

(60) Provisional application No. 60/039,321, filed on Feb. 7, 1997.

(30) Foreign Application Priority Data

Apr. 3, 1996 (GB) ..... 9607066

(51) Int. Cl.[7] ..... C07C 7/12

(52) U.S. Cl. ..... 208/251 R; 208/299; 208/301; 208/302; 208/303; 208/246; 208/247; 208/248; 208/296; 208/297; 208/253; 208/208 R; 95/133; 95/134; 95/135; 95/136; 95/137; 585/820; 585/822

(58) Field of Search ..... 208/299, 301, 208/302, 303, 246, 247, 248, 296, 297, 251 R, 253, 208 R; 95/133, 134, 135, 136, 137; 585/820, 822

(56) References Cited

U.S. PATENT DOCUMENTS

| | | | | |
|---|---|---|---|---|
| 2,015,080 | * | 9/1935 | Malisoff | 208/245 |
| 3,441,370 | * | 4/1969 | Gutmann et al. | 423/244.1 |
| 4,083,924 | * | 4/1978 | Styring | 423/88 |
| 4,094,777 | * | 6/1978 | Sugier et al. | 210/32 |
| 4,455,286 | * | 6/1984 | Young et al. | 423/230 |
| 4,593,148 | | 6/1986 | Nowalk . | |
| 4,871,710 | * | 10/1989 | Denny et al. | 502/414 |
| 4,894,210 | * | 1/1990 | Denny et al. | 423/230 |
| 4,902,662 | | 2/1990 | Toulhoat et al. . | |
| 4,909,926 | * | 3/1990 | Yan | 208/253 |
| 4,983,365 | * | 1/1991 | Denny et al. | 423/230 |
| 4,983,377 | | 1/1991 | Murphy et al. . | |
| 5,120,515 | * | 6/1992 | Audeh et al. | 423/210 |
| 5,245,106 | * | 9/1993 | Cameron et al. | 585/823 |
| 5,350,726 | | 9/1994 | Shaffer . | |
| 5,776,331 | * | 7/1998 | Khare et al. | 708/247 |
| 5,853,681 | * | 12/1998 | Denny et al. | 423/225 |
| 5,866,749 | * | 2/1999 | Ou | 585/845 |
| 5,891,323 | * | 4/1999 | Willis | 208/211 |
| 6,007,706 | * | 12/1999 | Carnell et al. | 208/303 |
| 6,033,556 | * | 3/2000 | Didillon et al. | 208/253 |
| 6,042,798 | * | 3/2000 | Masuda et al. | 423/244.01 |

FOREIGN PATENT DOCUMENTS

| | | |
|---|---|---|
| 0 465 854 | 1/1992 | (EP) . |
| 0 480 603 | 4/1992 | (EP) . |

* cited by examiner

*Primary Examiner*—Walter D. Griffin
*Assistant Examiner*—Nadine Preisch
(74) *Attorney, Agent, or Firm*—Pillsbury Winthrop LLP

(57) ABSTRACT

A process for the purification of a fluid stream containing a sulphur contaminant, such as hydrogen sulphide, and mercury, phosphine, stibine, and/or arsenic compounds as a second contaminant wherein said fluid stream is passed through a bed of a particulate absorbent containing a sulphide of a variable valency metal, especially copper, that is more electropositive than mercury, to remove said second contaminant and then the sulphur contaminant is removed from at least part of the effluent from that bed by passing that part of the effluent through a bed of a particulate sulphur absorbent comprising a compound selected from oxides, hydroxides, carbonates and basic carbonates of said variable valency metal is disclosed. The removal of the sulphur contaminant converts said variable valency metal compound to the corresponding sulphide. The resulting bed of variable valency metal sulphide is subsequently used for the removal of the second contaminant.

13 Claims, 4 Drawing Sheets

PROCESS FOR REMOVAL OF SULPHUR TOGETHER WITH OTHER CONTAMINANTS FROM FLUIDS

This is a continuation under 35 U.S.C. Section 120 of Ser. No. 09/145,165 filed on Sep. 2, 1998 now U.S. Pat. No. 6,007,706 which is a continuation under 35 U.S.C. Section 120 of PCT application PCT/GB97/00903 which designated the United States, filed internationally on Apr. 1, 1997, which is based on U.S. Provisional patent application No. 60/039,321 filed on Feb. 7, 1997.

This invention relates to a purification process and in particular to the removal of sulphur compounds together with other contaminants from fluid streams by absorption using particulate absorbent materials.

As a fluid stream containing a contaminant is passed through a bed of an absorbent for that contaminant, the contaminant is absorbed, initially at the inlet region of the bed, and the effluent from that bed contains little or none of the contaminant. Gradually the inlet region of the absorbent becomes saturated with the contaminant and the region where the absorption occurs moves gradually towards the outlet of the bed. Often the absorption front is relatively sharp: i.e. there is a clear distinction between the region of the bed where absorption has occurred (where the bed is partially or fully saturated with the contaminant) and downstream regions where the bed is essentially free of contaminant. When the adsorption front reaches the outlet of the bed, break-through is said to have occurred since the contaminant can then be detected in significant quantities in the effluent from the bed. Continued passage of the contaminated fluid through the bed will result in little or no further absorption of the contaminant.

Fluid streams, such as hydrocarbon liquids and gases, for example natural gas, are often contaminated with sulphur compounds and other contaminants such as elemental mercury, phosphine, stibine, arsine and/or organo-arsenic compounds such as mono-, di-, or tri-alkyl arsines. Various references, for example GB 1 533 059 and EP 0 465 854, disclose that mercury and such arsenic compounds can be removed by passing the fluid through a bed of a copper sulphide absorbent. U.S. Pat. No. 4,593,148 discloses that arsines and hydrogen sulphide can be removed together by the use of a bed of copper oxide and zinc oxide. EP 0 480 603 discloses that sulphur compounds and mercury may be removed together by passing the fluid stream through a bed of an absorbent containing copper compounds: the sulphur compounds are absorbed, forming copper sulphide, which then serves to remove the mercury.

The fluid stream generally contains a far greater amount of sulphur compounds, particularly hydrogen sulphide, than other contaminants. It is generally necessary to remove essentially all the mercury and arsine compounds, but often it is permissible for the product to contain a small amount of hydrogen sulphide. For example a typical natural gas may contain about 50 $\mu g/m^3$ of mercury and about 10 ppm by volume of hydrogen sulphide and it is desired that this gas is purified to a mercury content of less than 0.01 $\mu g/m^3$ and to a hydrogen sulphide content of 1–3 ppm by volume.

We have devised a simple process whereby essentially all of the mercury and/or arsenic compounds can be removed and the sulphur compounds content decreased to a specified level.

Accordingly the present invention provides a process for the purification of a fluid stream containing at least one sulphur contaminant selected from hydrogen sulphide, carbonyl sulphide, mercaptans and hydrocarbon sulphides and at least one second contaminant selected from mercury, phosphine, stibine, and arsenic compounds comprising passing said fluid stream through a bed of a particulate absorbent containing a sulphide of a variable valency metal that is more electropositive than mercury whereby said second contaminant is removed from said fluid stream but little or none of said sulphur contaminant is absorbed and then passing at least part of the effluent from said bed containing the variable valency metal sulphide through a bed of a particulate sulphur absorbent comprising at least one compound selected from oxides, hydroxides, carbonates and basic carbonates of said variable valency metal, whereby said sulphur contaminant is absorbed from that part of the effluent passing through said sulphur absorbent and converting said sulphur absorbent to a sulphide of said variable valency metal, characterised in that said bed of the variable valency metal sulphide has been produced by absorbing sulphur contaminants from a previous portion of said fluid stream from which said second contaminant has been removed.

In a preferred form, the present invention provides a process for the purification of a fluid stream containing at least one sulphur contaminant selected from hydrogen sulphide, carbonyl sulphide, mercaptans and hydrocarbon sulphides and at least one second contaminant selected from mercury, phosphine, stibine, and arsenic compounds comprising passing said fluid stream through a primary bed of a particulate absorbent containing a sulphide of a variable valency metal that is more electropositive than mercury, and having essentially no capacity for absorption of said sulphur contaminant under the prevailing conditions, whereby essentially all of said at least one second contaminant is removed from said fluid stream, passing part of the effluent from said primary bed through at least one secondary bed of a particulate sulphur absorbent comprising at least one compound selected from oxides, hydroxides, carbonates and basic carbonates of said variable valency metal, whereby at least part of said sulphur contaminant is absorbed from said part of the effluent from the primary bed by said variable valency metal compound by conversion thereof to a sulphide of said variable valency metal giving a first product stream that has a decreased sulphur contaminant content, mixing said first product stream with the remainder of the effluent from said primary bed to give a final product stream, the proportion of said effluent stream that is passed through said at least one secondary bed being such that the final product stream has the desired sulphur contaminant content, and, after at least one secondary bed is saturated so that it can no longer absorb said sulphur contaminant under the prevailing conditions, switching the flow of said fluid stream so that a saturated secondary bed is used as the primary bed of absorbent, replacing the absorbent in the previous primary bed with a fresh charge of particulate absorbent comprising said variable valency metal compound and then using said previous primary bed as a secondary bed.

It is seen that the absorption of the sulphur contaminant, e.g. hydrogen sulphide, by the secondary bed converts the aforesaid sulphur absorbent, i.e. oxide, hydroxide, carbonate or basic carbonate of the variable valency metal, in that bed to a sulphide of said variable valency metal which is then used as the bed, i.e. primary bed, of a sulphide of the variable valency metal required for removal of the second contaminant. When the process is first started up it is necessary that the absorbent in the primary bed comprises a sulphide of the variable valency metal. A pre-sulphided variable valency metal absorbent may be charged to the vessel as the primary bed. Alternatively the absorbent may be the product of sulphiding an absorbent comprising an oxide, hydroxide, carbonate or basic carbonate of the variable valency metal in situ, for example as described in aforesaid EP 0 480 603. Thus an unsulphided absorbent may be charged to the vessel and then a fluid containing a sulphur compound that reacts with the variable valency metal compounds to give the variable valency metal sulphide may be passed through the bed until the variable valency metal compounds have been converted to the sulphide. At that stage, flow of the fluid containing the second contaminant may be commenced.

As will be described hereinafter, it is preferred to employ a series of three secondary beds, and the fluid stream flow is switched after the second of the secondary beds has become saturated with sulphur, with the second of the secondary beds being used as the new primary bed and the replenished previous primary bed being used as the second of the secondary beds. In this case, the first of the secondary beds will also be saturated with sulphur when the second secondary bed is saturated and this saturated first secondary bed is also replenished and is then used as the third secondary bed. Thus at each switchover operation, the primary bed and the first secondary bed are replenished. While these beds are being replenished, only two beds are on absorption duty, namely the previous second secondary bed (which is now the new primary bed), and the previous third secondary bed (which is now the first secondary bed, and until the previous primary and first secondary beds have been replenished, is the only secondary bed). When the previous primary and first secondary beds have been replenished, they are brought into line as the second and third secondary beds respectively.

In the aforementioned arrangement utilising four beds, i.e. a primary bed and three secondary beds in series, it is preferred that the beds are located in two vessels. Thus the primary bed and the first secondary bed are located in one vessel and the second and third secondary beds are located in a second vessel. In a preferred arrangement, the two beds in each vessel form a single continuous bed but fluid off-take means is provided within the bed to withdraw part of the fluid from within the bed after the fluid has passed through the first part of the bed. The first part of the bed thus forms the primary bed. The fluid off-take means conveniently takes the form of a plurality of perforate pipes disposed within the bed with a mesh or cage round each pipe to prevent the particulate absorbent from entering the pipe perforations.

The variable valency metal may be any variable valency metal that is more electropositive than mercury. Examples of such metals include copper, manganese, chromium, tin, iron, cobalt, nickel and lead. Copper is the preferred variable valency metal. The sulphur absorbent charged to the secondary beds comprises an oxide, hydroxide, carbonate or basic carbonate of the variable valency metal. It may also contain other components such as oxides, hydroxides, carbonates and/or basic carbonates of zinc and/or aluminium. The presence of such other components is desirable as they appear to stabilise the variable valency compounds enabling the high absorption capacity of the tatter to be maintained. The presence of alumina in the absorbent is desirable where the fluid stream being treated contains carbonyl sulphide as the alumina catalyses the reaction of carbonyl sulphide with water (formed by the reaction of hydrogen sulphide and the variable valency metal compound) to give carbon dioxide and hydrogen sulphide. The absorbent is preferably in the form of porous high surface area agglomerates, typically of size in the range 2 to 10 mm average dimension. The agglomerates preferably have a BET surface area of at least 10 $m^2/g$. Such agglomerates may be obtained by forming a finely divided high surface area variable valency metal, e.g. copper, compound, or a precursor thereto, for example by a precipitation method, adding a binder such as a calcium aluminate cement and a little water, insufficient to form a paste, and granulating the mixture. Alternatively the absorbent may be formed by extruding a paste of the aforesaid finely divided high surface area variable valency metal compound, or precursor thereto, binder and water into short extrudates. The agglomerates or extrudates may then be dried and, if desired, cacined to convert the component compounds to oxides. It is however preferred to employ hydroxides, carbonates, or, more preferably, basic carbonates, as the variable valency metal compound in the sulphur absorbent and so it is preferred not to calcine the agglomerates or extrudates. Where other components, such as zinc and/or aluminium compounds, are required in the sulphur absorbent an intimate mixture of the variable valency metal compound and such other components may be formed, for example by co-precipitation, or by precipitation of the variable valency metal compound, or a precursor thereto, in the presence of the other components in a finely divided particulate form, and then the agglomerates or extrudates formed from this intimate mixture by addition of the binder etc. Examples of suitable agglomerates are described in EP 0 243 052 and PCT publication WO 95 24962.

Where the agglomerates also contain zinc compounds, the latter may also exhibit some capacity for the absorption of sulphur. However the present invention is of particular utility at relatively low temperatures, particularly below 50° C. At such temperatures zinc compounds exhibit little capacity for the absorption of sulphur. Under such conditions it is believed that essentially all the absorbed sulphur is absorbed by the variable valency metal compound and any zinc compounds merely act as stabilisers. It is therefore preferred that the variable valency metal compounds form at least 75% by weight of the agglomerates.

The fluid being treated may be a hydrocarbon stream, e.g. natural gas, substitute natural gas, natural gas liquids, naphtha, reforming gases, for example hydrocarbon streams such as propylene separated from the product of cracking naphtha; synthesis gas produced, for example, by the partial oxidation of a carbonaceous feedstock; organic compounds such as alcohols, esters, or chlorinated hydrocarbons; or other gases such as carbon dioxide, hydrogen, nitrogen, or helium.

The process is conveniently carried out at a temperature in the range −10° C. to 50° C. The absorption process may be effected at any suitable pressure; typical pressures range from atmospheric up to about 200 bar abs. Under these conditions the fluid may be gaseous, or liquid, or in the case of fluids which are mixtures of components such as hydrocarbons, for example natural gas, in the so-called dense phase, i.e. at a temperature between the critical temperature and the temperature of the maxcondentherm point but at a pressure above that of the upper dew point at that temperature.

The invention is illustrated by reference to the accompanying drawings wherein

In FIGS. 1 to 8 control valves are omitted for clarity. Broken lines indicate flow paths not in use at the stage indicated. In FIGS. 1, 6, 7 and 8 the beds are shown as separate entities whereas in FIGS. 2 to 5 two vessels are used each containing two beds.

Figure 1:
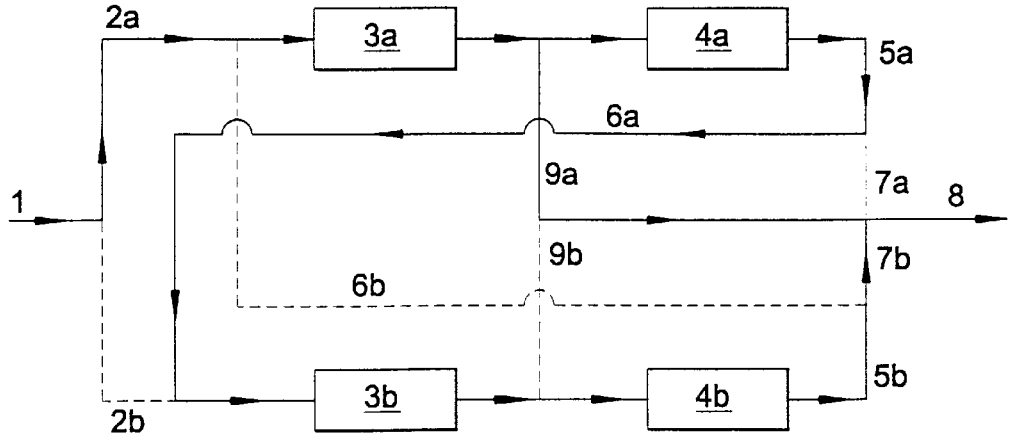
FIG. 1 is a diagrammatic flowsheet of the process of the invention.
Figure 2:
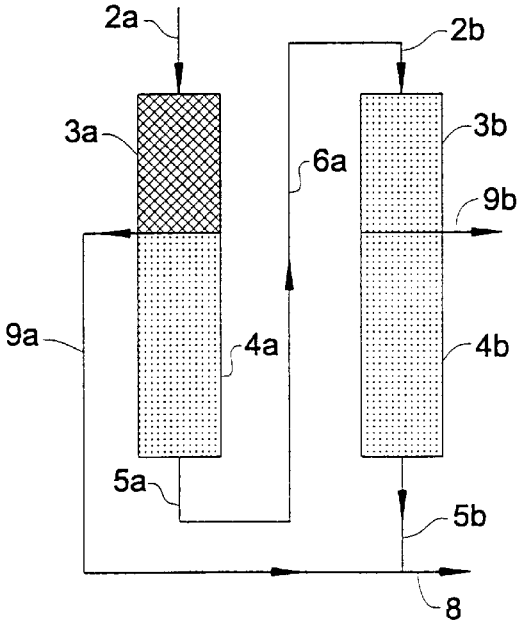
FIGS. 2 to 5 are diagrammatic flowsheets showing the progressive absorption of the impurities in the flowsheet of FIG. 1, FIGS. 6 to 8 are flowsheets similar to FIG. 1 showing successive stages of the process.

FIGS. 1 and 2 show the process at the start of operation. The fluid feed, e.g. natural gas at a temperature of 20° C. and a pressure of 120 bar abs. containing 8 ppm by volume of hydrogen sulphide and 50 $\mu g/m^3$ of elemental mercury, is fed via lines 1 and 2*a* to a primary bed 3*a* of absorbent. At the start of operation, as shown in FIG. 2, primary bed 3*a* contains agglomerates comprising a sulphide of a variable valency metal, e.g. copper sulphide, while secondary bed 4*a* (in the same vessel as bed 3*a*) and secondary beds 3*b* and 4*b* (both in a second vessel) each contain fresh absorbent comprising agglomerates comprising at least one compound selected from oxides, hydroxides, carbonates, or, preferably, basic carbonates, of the variable valency metal.

Figure 3:
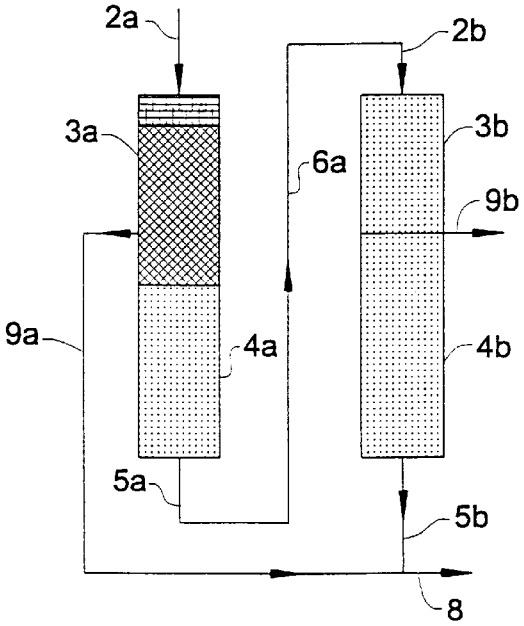
Figure 3:
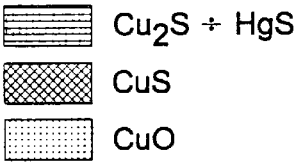

As shown in FIGS. 1 and 3, during passage through bed 3*a*, the mercury is absorbed by the variable valency metal sulphide, forming mercury sulphide, e.g. via the reaction $$2CuS-Hg \rightarrow HgS+Cu_2S$$

while little or none of the hydrogen sulphide in the feed is absorbed. The effluent from bed 3*a* thus contains hydrogen sulphide in essentially the same concentration as in the feed to bed 3*a*. Part of the effluent from bed 3*a* is passed through the first secondary bed 4*a* and then via lines 5*a* and 6*a* through the second and third secondary beds 3*b* and 4*b*. After passage through beds 3*b* and 4*b*, the fluid leaves bed 4*b* via lines 5*b* and 7*b* to give a product stream 8.

Figure 4:
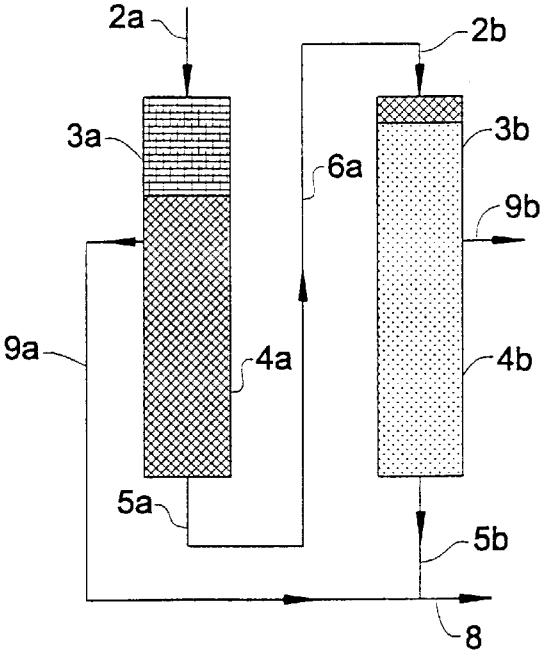
Figure 5:
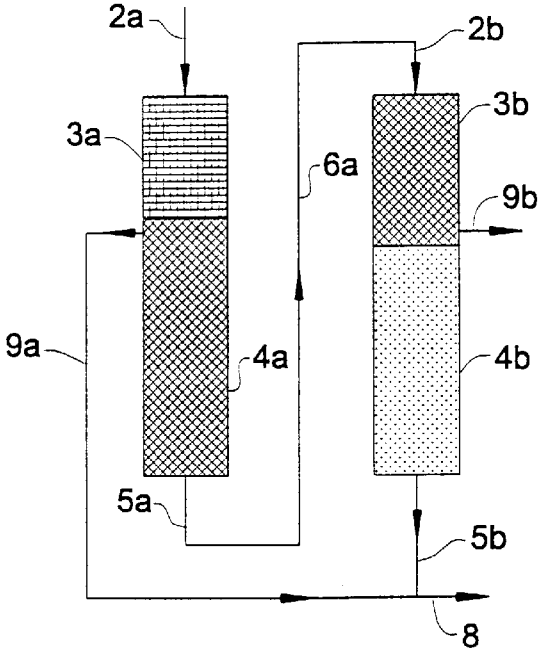

As shown in FIG. 3, during passage of the fluid through bed 4*a*, hydrogen sulphide is absorbed from the fluid, converting the oxides, hydroxides, carbonates, or, preferably, basic carbonates, of the variable valency metal, to the variable valency sulphide. Eventually bed 4*a* becomes saturated with hydrogen sulphide so that break-through occurs and hydrogen sulphide is detectable in line 5*a*. Thereafter, as shown in FIG. 4, hydrogen sulphide is absorbed by bed 3*b*. Eventually, as shown in FIG. 5, bed 3*b* becomes saturated with hydrogen sulphide so that bed 4*b* starts to absorb hydrogen sulphide. The beds are sized such that the beds 4*a* and 3*b* become saturated with sulphur before the mercury absorption front reaches the exit of bed 3*a*.

While part of the effluent from bed 3*a* is passing through beds 4*a*, 3*b* and 4*b*, the remainder is taken via line 9*a* and mixed with the fluid from line 7*b* to give the final product stream 8. The hydrogen sulphide content of stream 8 is controlled by controlling the proportion of hydrogen sulphide containing fluid taken via line 9*a*. Since the fluid that has passed through beds 4*a*, 3*b*, and 4*b* is essentially free from hydrogen sulphide, it is seen that the proportion of the fluid that is taken via line 9*a* depends directly on the ratio of the desired hydrogen sulphide content of the product to the hydrogen sulphide content of the feed. Control may be achieved by means of control valves responsive to the monitored the hydrogen sulphide content of the feed.

Figure 6:
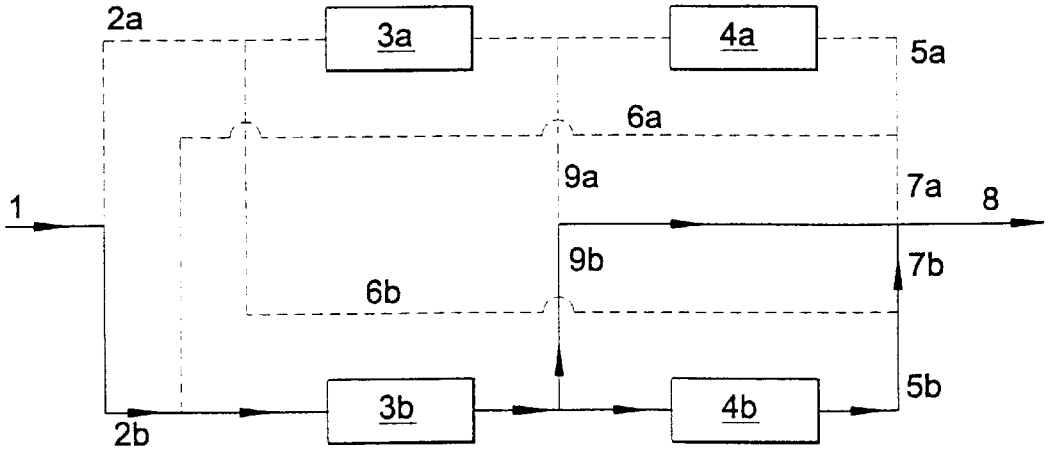

When bed 3*b* becomes saturated with hydrogen sulphide, for example as detected by monitoring the hydrogen sulphide content of the effluent from bed 3*b*, the flow of feed is switched from line 2*a* to line 2*b* (see FIG. 6). Part of the effluent from bed 3*b* is passed through bed 4*b* to remove hydrogen sulphide and fed via lines 5*b* and 7*b* into the final product stream while the remainder of the effluent from bed 3*b* is taken via line 9*b* as the rest of the product stream. Beds 3*a* and 4*a* are thus offline and can be replenished with fresh absorbent.

Figure 7:
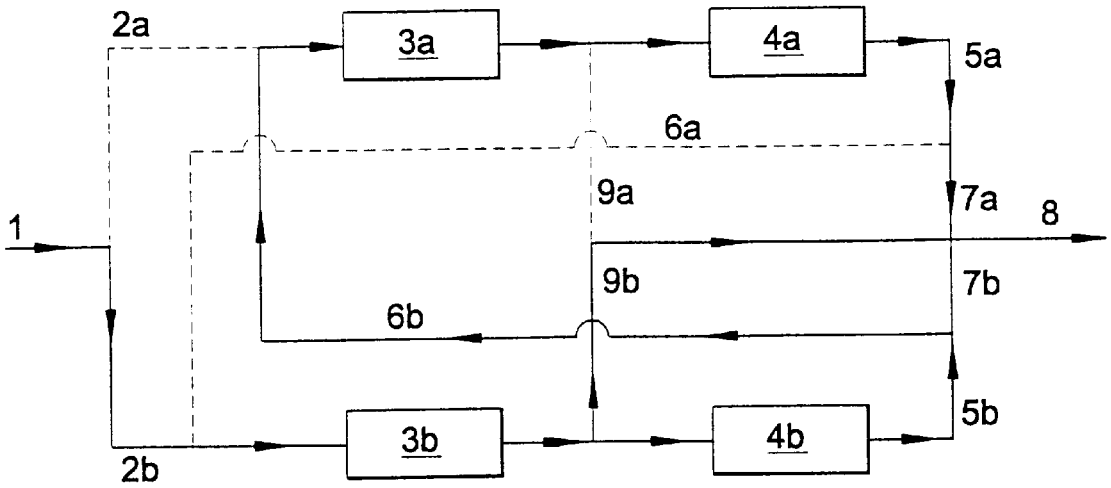
Figure 8:
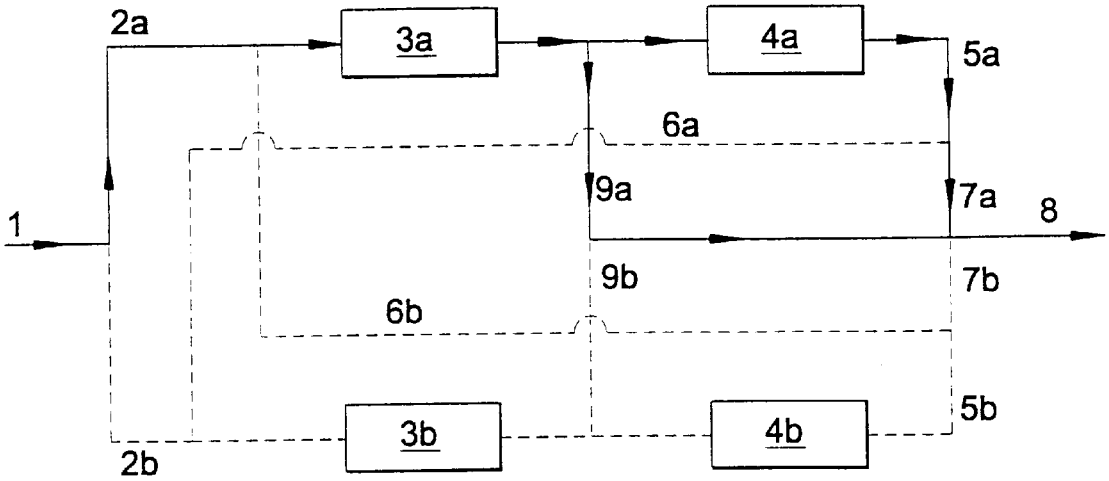

After beds 3*a* and 4*a* have been replenished and before bed 4*b* is saturated with hydrogen sulphide, the flow from bed 4*b* is switched, as shown in FIG. 7, to line 6*b* and hence through beds 3*a* and 4*a*, and via lines 5*a* and 7*a* to the product stream 8. When bed 4*b* becomes saturated, bed 3*a* starts absorbing hydrogen sulphide and converting the variable valency metal compound therein to the corresponding sulphide. When bed 3*a* is saturated with hydrogen sulphide, and so ready to absorb mercury, the system is switched (see FIG. 8) with the feed to line 2*a* and bed 3*a*. Part of the effluent from bed 3*a* passes through bed 4*a* to absorb hydrogen sulphide and then passes via lines 5*a* and 7*a* into the product stream 8 while the remainder of the effluent from bed 3*a* is taken via line 9*a* to form the rest of product stream 8. Beds 3*b* and 4*b* are replenished and then the system switched back to the arrangement of FIG. 1 and the cycle repeated.

The beds are preferably sized so that the period between replenishment of the beds is typically in the range 1 week to 1 year.

Figure 9:
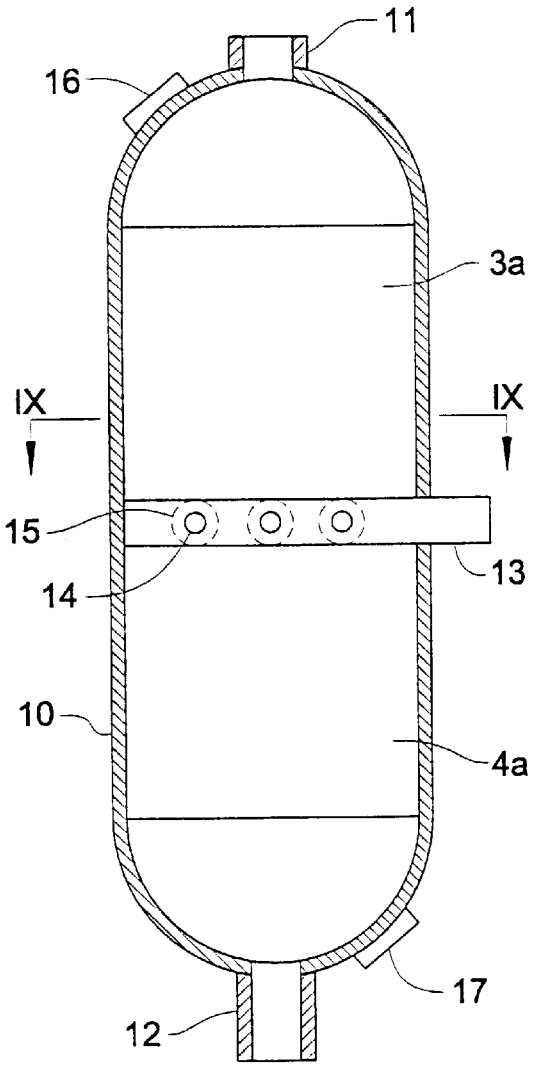
FIG. 9 is a diagrammatic cross section of a reactor containing two beds with a fluid take-off means.
Figure 10:
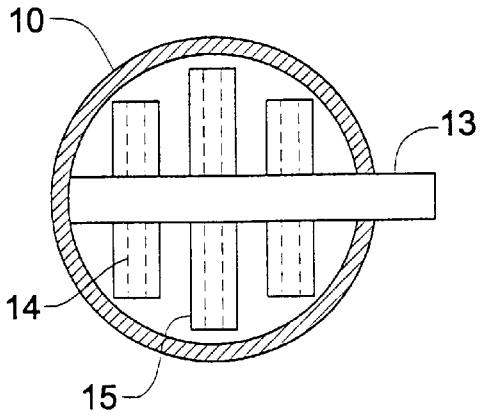
FIG. 10 is a section along the line IX—IX of FIG. 9.

In FIGS. 9 and 10 there is shown a preferred form of absorbent vessel for containing beds 3*a* and 4*a*. The vessel has an outer shell 10 and is provided with an inlet port 11 at the upper end and an outlet port 12 at the lower end. Port 11 is connected to line 2*a* and port 12 is connected to line 5*a* of FIGS. 1 to 4. Disposed across the interior of the shell 10 and out through the shell is a hollow header 13 which is connected to line 9*a* of FIGS. 1 to 4. Extending laterally from header 13 are a plurality of pipes 14. These pipes are closed at their outer ends but at their inner ends communicate with the interior of header 13. Piper 14 have a plurality of perforations (not shown in FIG. 9 or 10) therethrough. Surrounding each lateral pipe 14 is a mesh cage 15.

In use, the vessel is charged with absorbent through a manhole 16 at the upper end of the shell 10. The portion of the absorbent above header 13 and lateral pipes 14 forms the bed 3*a* while the portion of the absorbent below header 13 and pipes 14 forms the bed 4*a*. The mesh cages 15 serve to prevent the absorbent particles, e.g. agglomerates from blocking the perforations in pipes 14. Thus part of the fluid that has passed down through the upper portion of the absorbent from port 11 can enter cages 15 and then pass through the perforations in pipes 14 and flow through the header 13, while the reminder of the fluid passes between the cages 15 and passes through the absorbent in the lower part of the vessel and leaves via port 12. A manhole 17 is provided to permit the absorbent to be discharged.

What is claimed is:

1. A process for the purification of a fluid stream containing at least one sulphur contaminant selected from hydrogen sulphide, carbonyl sulphide, mercaptans and hydrocarbon sulphides and at least one second contaminant selected from mercury, phosphine, stibine, and arsenic compounds comprising passing said fluid stream through a bed of a particulate absorbent containing a sulphide of a variable valency metal that is more electropositive than mercury whereby said second contaminant is removed from said fluid stream but little or none of said sulphur contaminant is absorbed and then passing at least part of the effluent from said bed containing the variable valency metal sulphide through a bed of a particulate sulphur absorbent comprising at least one compound selected from oxides, hydroxides, carbonates and basic carbonates of said variable valency metal, whereby said sulphur contaminant is absorbed from that part of the effluent passing through said sulphur absorbent and converting said sulphur absorbent to a sulphide of said variable valency metal, wherein said bed of the variable valency metal sulphide has been produced by absorbing sulphur contaminants from a previous portion of said fluid stream from which said second contaminant has been removed.

2. A process according to claim 1 wherein the variable valency metal comprises copper.

3. A process according to claim 2 wherein the particulate sulphur absorbent comprises basic copper carbonate.

4. A process according to claim 1, wherein the particulate sulphur absorbent also contains oxides, hydroxides, carbonates and/or basic carbonates of zinc and/or aluminium.

5. A process according to claim 1 wherein the fluid stream is passed through the beds at a temperature in the range of −10° C. to 50° C.

6. A process for the purification of a fluid stream containing at least one sulphur contaminant selected from hydrogen sulphide, carbonyl sulphide, mercaptans and hydrocarbon sulphides and at least one second contaminant selected from mercury, phosphine, stibine, and arsenic compounds comprising passing a portion of said fluid stream through a bed of a particulate absorbent containing a sulphide of a variable valency metal that is more electropositive than mercury whereby said second contaminant is removed from said fluid stream but little or none of said sulphur contaminant is absorbed, thereby producing a fluid stream free of said second contaminant but containing said sulphur contaminant which is then passed through a first bed of a particulate sulphur absorbent comprising at least one compound selected from oxides, hydroxides, carbonates and basic carbonates of said variable valency metal, whereby said sulphur contaminant is absorbed and said sulphur absorbent is converted to a sulphide of said variable valency metal, and thereafter passing a second portion of said fluid stream through said first bed of converted sulphur absorbent whereby said second contaminant is removed from said second portion of said fluid stream but little or none of said sulphur contaminant is absorbed, and then passing at least part of said second portion of said fluid stream that has passed through said first bed of converted sulphur absorbent through a second bed of a particulate sulphur absorbent comprising at least one compound selected from oxides, hydroxides, carbonates and basic carbonates of said variable valency metal, whereby said sulphur contaminant is absorbed from that part of said second portion of said fluid stream that has passed through said first bed of converted sulphur absorbent and said sulphur absorbent in said second bed is converted to a sulphide of said variable valency metal.

7. A process according to claim 6 wherein the variable valency metal comprises copper.

8. A process according to claim 7 wherein the particulate sulphur absorbent of said first and second beds comprises basic copper carbonate.

9. A process according to claim 6 wherein the particulate sulphur absorbent of said first and second beds also contains oxides, hydroxides, carbonates and/or basic carbonates of zinc and/or aluminium.

10. A process according to claim 6 wherein the first and second portions of said fluid stream is passed through the beds at temperatures in the range of −10° C. to 50° C.

11. A process for the purification of a fluid stream containing at least one sulphur contaminant selected from hydrogen sulphide, carbonyl sulphide, mercaptans and hydrocarbon sulphides and at least one second contaminant selected from mercury, phosphine, stibine, and arsenic compounds, comprising passing said fluid stream through a first primary bed of a particulate absorbent containing a sulphide of a variable valency metal that is more electropositive than mercury, and having essentially no capacity for absorption of said sulphur contaminant, whereby essentially all of said at least one second contaminant is removed from said fluid stream, passing part of the effluent from said primary bed through a first series of three secondary beds of a particulate sulphur absorbent comprising at least one compound selected from oxides, hydroxides, carbonates and basic carbonates of said variable valency metal, whereby at least part of said sulphur contaminant is absorbed from said part of the effluent from the primary bed by said variable valency metal compound by conversion thereof to a sulphide of said variable valency metal; switching said fluid stream flow when the second of said secondary beds has become saturated with sulphur and the absorbent thereof converted to a sulphide of said variable valency metal and passing said fluid stream through a second primary bed and the first secondary bed of a second series of three secondary beds, wherein said second primary bed is the aforesaid second secondary bed of the first series of secondary beds and the first secondary bed of the second series of secondary beds is the third secondary bed of said first series of secondary beds, replenishing the first primary bed and first secondary bed of said first series of secondary beds with a fresh quantity of said at least one compound and thereafter using the replenished first primary bed and first secondary bed of the first series of secondary beds as, respectively, the second and third secondary beds of said second series of beds.

12. A process according to claim 11 wherein the first primary and first secondary bed of the first series of secondary beds are disposed in a first vessel and the second and third secondary beds of said first series of secondary beds are disposed in a second vessel.

13. A process according to claim 11 wherein the first primary and first secondary bed of the first series of secondary beds are disposed as a single continuous bed in a first vessel whereby the first part of the bed forms the first primary bed and the remainder of said bed forms the said first secondary bed, and after the fluid stream has passed through said first primary bed, part of the effluent from said first primary bed is withdrawn from said vessel through fluid take off means disposed within said continuous bed and the second and third secondary beds of said first series of secondary beds are disposed as a single continuous bed in a second vessel similarly provided with fluid take-off means whereby the first portion of the bed in the second vessel forms the second secondary bed of said first series of secondary beds, and the remainder of the bed in said second vessel forms the third secondary bed of said first series of secondary beds.

* * * * *